US008224409B2

(12) United States Patent
Yamanaka et al.

(10) Patent No.: US 8,224,409 B2
(45) Date of Patent: Jul. 17, 2012

(54) THREE-DIMENSIONAL FILTER WITH MOVABLE SUPERCONDUCTING FILM FOR TUNING THE FILTER

(75) Inventors: Kazunori Yamanaka, Kawasaki (JP); Akihiko Akasegawa, Kawasaki (JP); Keisuke Sato, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 233 days.

(21) Appl. No.: 12/400,278

(22) Filed: Mar. 9, 2009

(65) Prior Publication Data

US 2009/0280991 A1 Nov. 12, 2009

(30) Foreign Application Priority Data

May 8, 2008 (JP) ..... 2008-122103

(51) Int. Cl.
*H01P 1/20* (2006.01)
*H01B 12/02* (2006.01)

(52) U.S. Cl. ..... 505/210; 333/99 S; 333/202; 333/235

(58) Field of Classification Search ..... 333/99 S, 333/202, 219.1, 235; 505/210
See application file for complete search history.

(56) References Cited

U.S. PATENT DOCUMENTS

| | | | | |
|---|---|---|---|---|
| 4,307,352 | A * | 12/1981 | Shinkawa et al. | 331/99 |
| 4,613,838 | A | 9/1986 | Wada et al. | |
| 5,179,074 | A * | 1/1993 | Fiedziuszko et al. | 505/210 |
| 5,324,713 | A * | 6/1994 | Shen | 505/210 |
| 5,391,543 | A * | 2/1995 | Higaki et al. | 505/210 |
| 5,608,363 | A * | 3/1997 | Cameron et al. | 333/202 |
| 5,805,033 | A * | 9/1998 | Liang et al. | 333/202 |
| 6,143,697 | A | 11/2000 | Tatekawa et al. | |
| 6,185,441 | B1 | 2/2001 | Wikborg et al. | |
| 6,470,198 | B1 * | 10/2002 | Kintaka et al. | 505/210 |
| 6,778,042 | B2 | 8/2004 | Terashima et al. | |
| 2005/0128031 | A1 * | 6/2005 | Wilber et al. | 333/202 |

FOREIGN PATENT DOCUMENTS

| | | | |
|---|---|---|---|
| JP | 54-81247 | U | 6/1979 |
| JP | 55-44232 | A | 3/1980 |
| JP | 61-61503 | A | 3/1986 |
| JP | 1-126709 | | 8/1989 |
| JP | 4-167607 | A | 6/1992 |
| JP | 7-500956 | | 1/1995 |
| JP | 10-178301 | | 6/1998 |
| JP | 11-507786 | A | 7/1999 |
| JP | 2000-63120 | A | 2/2000 |
| JP | 2001-521712 | A | 11/2001 |
| JP | 2002-141705 | A | 5/2002 |
| JP | 2002-204102 | A | 7/2002 |

(Continued)

OTHER PUBLICATIONS

T. Hashimoto et al., "Frequency Dependence Measurements of Surface Resistance of Superconductors Using Four Modes in a Sapphire Rod Resonator", Special Issue on Microwave and Millimeter Wave Technology Aug. 2003, pp. 1721-1728, vol. E86-C, No. 8.

(Continued)

*Primary Examiner* — Benny Lee
(74) *Attorney, Agent, or Firm* — Fujitsu Patent Center

(57) ABSTRACT

A three-dimensional filter includes a pair of superconductor films opposed to each other, and a three-dimensional resonator made of dielectric and situated between the superconductor films, wherein one of the superconductor films is movable relative to the three-dimensional resonator.

12 Claims, 15 Drawing Sheets

FOREIGN PATENT DOCUMENTS

| | | | |
|---|---|---|---|
| JP | 2003-234601 | A | 8/2003 |
| JP | 2004-200892 | A | 7/2004 |

OTHER PUBLICATIONS

T. Hashimoto et al., "Two-Sapphire-Rod-Resonator Method to Measure the Surface Resistance of High-Tc Superconductor Films", Special Section on Measurement Technologies for Microwave Materials, Devices and Circuits, May 2004, pp. 681-688, vol. E87-C, No. 5.

Japanese Office Action mailed Nov. 15, 2011 for corresponding Japanese Application No. 2008-122103, with Partial English-language Translation.

Japanese Office Action mailed May 15, 2012 for corresponding Japanese Application No. 2008-122103, with English-language translation.

* cited by examiner

THREE-DIMENSIONAL FILTER WITH MOVABLE SUPERCONDUCTING FILM FOR TUNING THE FILTER

CROSS-REFERENCE TO RELATED APPLICATIONS

The present application is based upon and claims the benefit of priority from the prior Japanese Patent Application No. 2008-122103 filed on 8 May 2008, with the Japanese Patent Office, the entire contents of which are incorporated herein by reference.

FIELD

The disclosures herein generally relate to three-dimensional filters and tunable filter apparatuses using three-dimensional filters, and particularly relate to a three-dimensional filter and a tunable filter apparatus suitable for transmission of high frequency signals.

BACKGROUND

A bandpass filter designed to be used for a conventional electrical power level may be utilized for a high frequency transmission system using a microwave band in a radio base station. To this end, it is desirable for a bandpass filter to tolerate high electrical power, to have a high Q factor, and to have a passband whose center frequency is variable over a wide range. It is not easy, however, to simultaneously satisfy these conditions.

Among RF filters for use in a base station using frequencies lower than a few GHz, a receiving filter that employs a signal power smaller than a few watts (W) may be one of a coaxial resonator type, a dielectric resonator type, and a superconductor resonator type. Such a receiving filter is not so much required to have a compact size as required to have high frequency selectivity. In term of frequency selectivity, a receiving filter equipped with a resonator circuit utilizing an oxide high-temperature superconductor film is advantageous in that it provides a high unloaded Q factor.

In the case of a superconductor-type transmitting filter using high electrical power, it is not easy to simultaneously achieve size compactness and proper electrical power characteristics (such as power tolerance). This presents a major challenge.

Among various superconducting filters, a filter having a planer-circuit structure has a resonator pattern formed of a superconductive material on a dielectric substrate. Attempts that have been made to achieve size compactness and improve power characteristics for such a planar-circuit-type superconducting filter include:

(a) forming the pattern of the superconductor film of the resonator circuit in a patch shape such as a circular shape or polygon shape to reduce the concentration of electrical current density; and (b) attempting to control grain boundary, impurities, and the like to develop a higher-quality oxide high-temperature superconductor film.

It is also known to those skilled in the art to use a dielectric block in addition to the dielectric substrate on which a resonator pattern is formed. The provision of such a dielectric block can, to some extent, reduce the concentration of electrical current density on the superconductor.

Various studies on the three-dimensional structure of a superconducting filter have been made, including studies on a resonator as part of the basic structure and studies on application to an acceleration cavity. In the case of a resonator utilizing an oxide high-temperature superconductor, a high unloaded Q factor exceeding a few hundred thousands has been reported with regard to a structure in which superconductor films are provided at the top and bottom of a dielectric block (see Non-Patent Document 1 and Non-Patent Document 2, for example).

There has also been a report that studies a method of making an oxide-superconductor-based resonator tunable. As an example of such an attempt, it is known to those skilled in the art to use a configuration in which a dielectric plate is arranged above a planar resonator pattern formed of an oxide superconductor film, and the elevation of the dielectric plate is adjusted (see Patent Document 1, for example). In this configuration, the elevation of the dielectric film is controlled by adjusting a voltage applied to a piezoelectric element.

The tunable filter having a configuration as disclosed in the above cited publications tends to cause degradation in Q characteristics. Further, it remains to be a challenge to drive such a filter with a power higher than a few tens watts (W) in a configuration in which plural stages are utilized to achieve a frequency cutoff characteristic that is sufficiently steep for practical purposes.

It may be thus desirable to provide a tunable filter structure for a high-frequency filter that can provide improvements for the problems described above.

[Patent Document 1] Japanese Patent Application Publication No. 2002-204102

[Non-Patent Document 1] T. Hashimoto and Y. Kobayashi, "Frequency dependence measurements of surface resistance of superconductors using four modes in a sapphire rod resonator," IEICE Trans. Electron., VOL. E86-C, No. 8, pp. 1721-1728, August 2003

[Non-Patent Document 2] T. Hashimoto and Y. Kobayashi, "Two-Sapphire-Rod-Resonator Method to Measure the Surface Resistance of High-Tc Superconductor Films," IEICE Trans. Electron., Vol. E87-C, No. 5, pp. 681-688, May 2004

SUMMARY OF THE INVENTION

According to an aspect of the present disclosures, a three-dimensional filter includes a pair of superconductor films opposed to each other, and a three-dimensional resonator made of dielectric and situated between the superconductor films, wherein one of the superconductor films is movable relative to the three-dimensional resonator.

According to an aspect of the present disclosures, a tunable filter apparatus includes a conductor case, a three-dimensional filter including a pair of superconductor films opposed to each other and a three-dimensional resonator situated between the superconductor films, wherein one of the superconductor films is configured to be movable inside the conductor case, and first and second waveguides coupled to the conductor case along a direction perpendicular to a direction in which the one of the superconductor films is movable.

According to an aspect of the present disclosures, a tunable filter apparatus includes first and second conductor cases arranged adjacent to each other, an opening formed through adjacent faces of the first and second conductor cases, first and second three-dimensional filters placed in the first and second conductor cases, respectively, and a shutter configured to be inserted into a space between the first and second conductor cases to adjust an area size of the opening.

According to at least one embodiment, a three-dimensional filter and a tunable filter apparatus that are suitable for a microwave electrical power and have tunable frequency characteristics are provided.

The object and advantages of the embodiment will be realized and attained by means of the elements and combinations particularly pointed out in the claims. It is to be understood that both the foregoing general description and the following detailed description are exemplary and explanatory and are not restrictive of the invention, as claimed.

DETAILED DESCRIPTION OF THE PREFERRED EMBODIMENTS

Prior to providing a description of preferred embodiments with the accompanying drawings, a description of a basic configuration will be given first. In the embodiments, a dielectric block is used as a three-dimensional resonator to constitute a three-dimensional filter. Superconductor films are arranged on the two sides of the dielectric block (i.e., three-dimensional resonator) such that one of the two sides is opposite to the other side along a line perpendicular to the signal travel direction, e.g., arranged over and under the dielectric block. The position of one of the superconductor films relative to the dielectric block is changed to achieve a variable resonance frequency.

Figure 1:
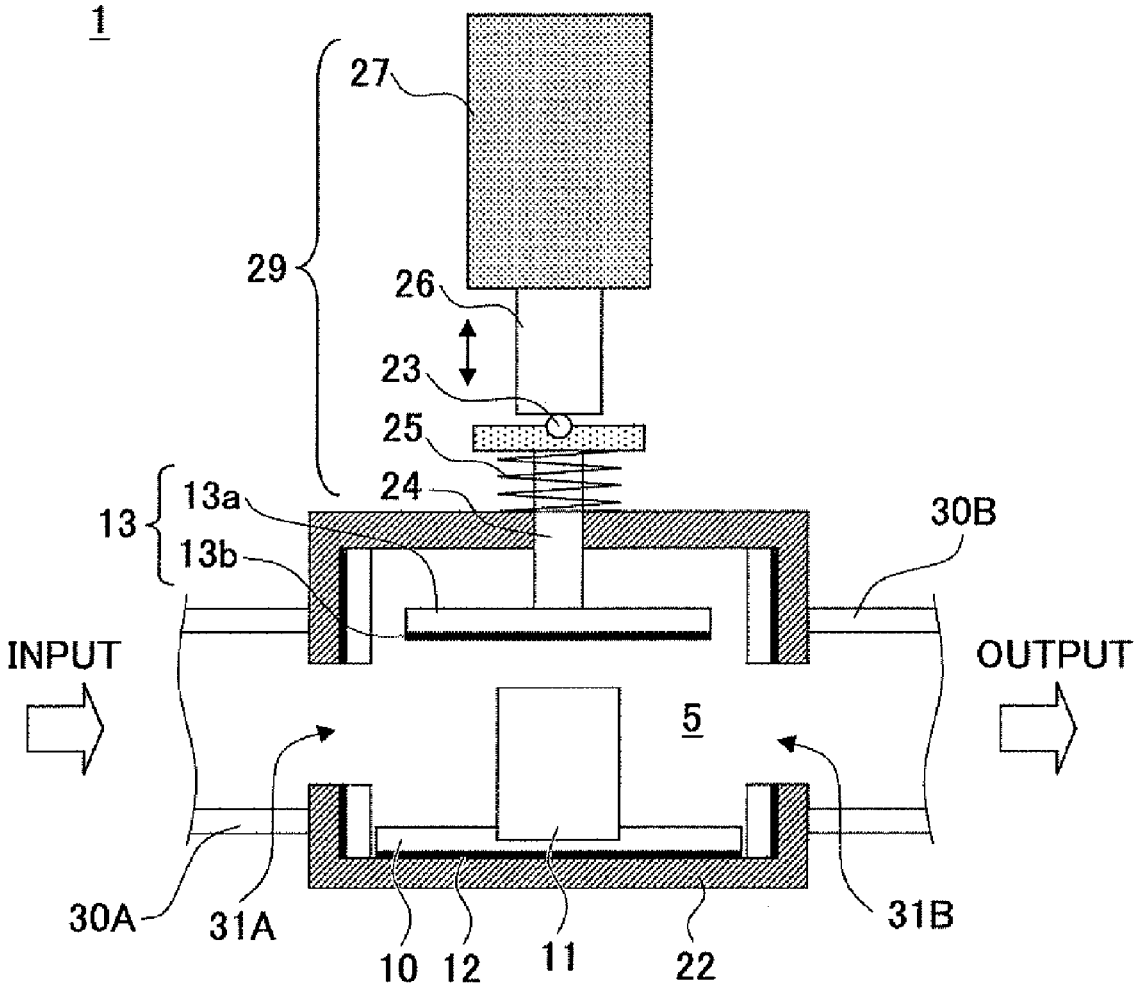
FIG. 1 is a schematic diagram of a tunable filter apparatus according to a first embodiment.

FIG. 1 is a schematic diagram of a tunable filter apparatus 1 according to a first embodiment. The tunable filter apparatus 1 includes a dielectric block 11 serving as a three-dimensional resonator, a superconductor film 12 situated under the dielectric block 11, and a superconductor film 13*b* movably situated over the dielectric block 11. In the example illustrated in FIG. 1, the position of the superconductor film 13*b* relative to the dielectric block 11 is adjustable by use of a drive mechanism 29.

The movable superconductor film 13*b* is formed on the surface of a dielectric substrate 13*a* that faces the dielectric block 11. The dielectric substrate 13*a* and the superconductor film 13*b* together constitute a superconductor-film-covered dielectric substrate 13. A superconductor film 12 situated under the dielectric block 11 is formed on the back surface of a dielectric substrate 10, and is fixed as to its position. A pair of the superconductor films 12 and 13*b* and the dielectric block 11 together constitute a three-dimensional filter 5. The three-dimensional filter 5 is placed inside a conductor case 22 made of copper, aluminum, an alloy thereof, or the like. The interior side walls of the conductor case 22 are preferably covered with superconductor-film-covered dielectric substrates. In the example illustrated in FIG. 1, signals (electromagnetic waves) travel in a direction indicated by arrows from the left-hand side to the right-hand side of the figure along the surface of the drawing sheet. The same or similar designation of a signal travel direction will also be used in subsequent figures (i.e., FIG. 5 and FIGS. 7A through 7C).

The superconductor-film-covered dielectric substrate 13 is coupled to the drive mechanism 29. The drive mechanism 29 includes a movable rod 24 penetrating through the conductor case 22 to couple to the superconductor-film-covered dielectric substrate 13, a spring 25, an actuator 27, an actuator movable part (displaceable part) 26 which moves in a direction illustrated by a vertical double headed arrow, and a ball joint 23. The actuator 27 is an oil-less piezoelectric actuator (either of a rotating type or a linear type) utilizing PZT or the like. The ball joint 23 compensates for movement associated with axial misalignment between the actuator 27 and the movable rod 24. When a configuration that directly connects the actuator 27 to the movable rod 24 is employed, there is no need to provide the ball joint 23 and the spring 25.

The three-dimensional filter 5 illustrated in FIG. 1 is applicable to a transmitting filter, and waveguide tubes 30A and 30B are used to input and output signals into and from the three-dimensional filter 5, respectively. A signal (electromagnetic wave) propagating through the waveguide tube 30A passes through an opening 31A of the conductor case 22 to be incident on the dielectric block 11 where frequency components corresponding to the natural resonance frequency of the dielectric block 11 are extracted. A signal passing through the dielectric block 11 is output to the waveguide tube 30B through an opening 31B situated on the opposite side.

The waveguide tubes 30A and 30B may be a rectangular waveguide tube, and signals propagate therein in a TE mode. The electromagnetic wave entering the conductor case 22 through the opening 31A is placed in a TM mode at the dielectric block 11, so that the resonating electrical field is concentrated on the dielectric block 11. This suppresses the pinpoint concentration of electrical fields on the superconductor film 13*b*. This arrangement is thus more advantageous in terms of power tolerance compared with a planar-circuit-type superconductor resonator.

The opening 31A of the conductor case 22 is configured to be narrower than the cross-section (i.e., the cross-section perpendicular to the travel direction) of the waveguide tube 30A in order to cause the signal having propagated through the waveguide tube 30A to resonate upon entering the conductor case 22. Namely, only microwaves having particular frequencies satisfying the resonance conditions can enter the conductor case 22 through the opening 31A. The same applies to the opening 31B and the waveguide tube 30B on the output side.

The entirety of the tunable filter apparatus 1 is placed in a cooling case. The tunable filter apparatus 1 function as an electromagnetic-field resonator having a high unloaded Q factor at temperature sufficiently lower than a superconductivity critical temperature Tc.

Figure 2A:
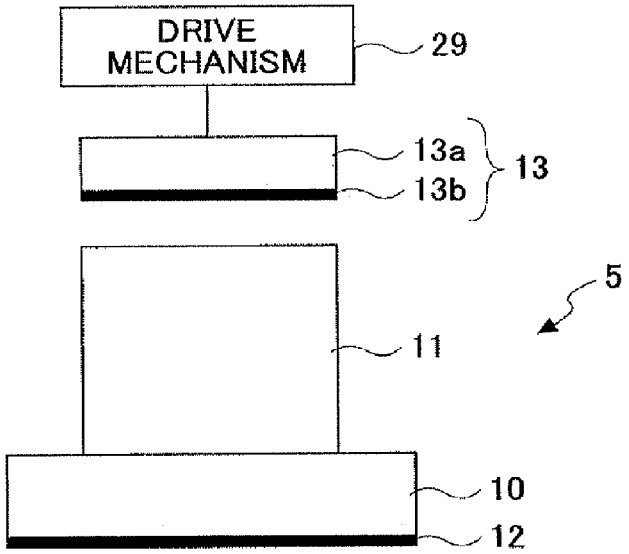
FIGS. 2A through 2C are drawings illustrating examples of the configuration of a three-dimensional filter used in the tunable filter apparatus illustrated in FIG. 1.
Figure 2B:
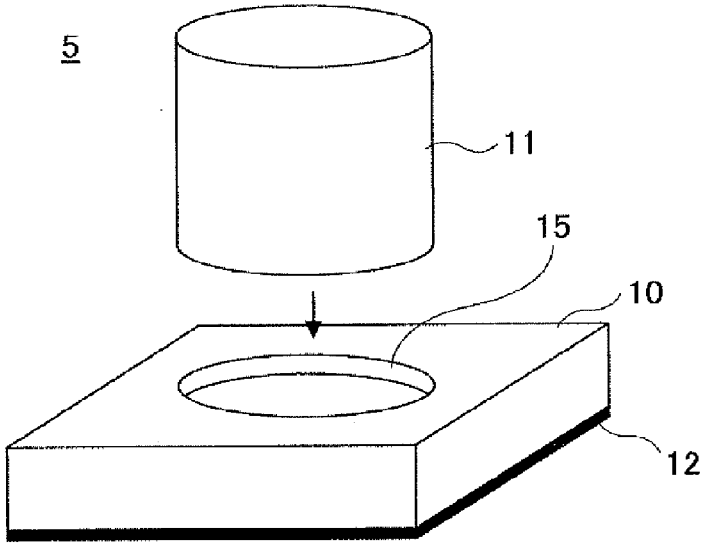
Figure 2C:
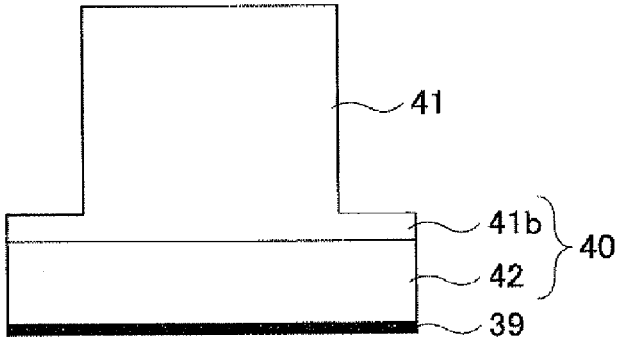

FIGS. 2A through 2C are drawings illustrating examples of the configuration of the three-dimensional filter 5. In an example illustrated in FIG. 2A, the superconductor film 12 that is positionally fixed is formed of a superconductor material such as YBCO (i.e., $YBa_2Cu_3O_x$, x=6.90~6.99) on the back surface of the dielectric substrate 10 made of MgO(100) crystal, $LaAlO_3$(100) crystal, or the like. The dielectric substrate 10 functions as a base platform of the three-dimensional filter 5. The dielectric block 11 is a cylindrical block projecting from the dielectric substrate 10, and may be made of alumina, sapphire, titania, or the like. The term "block" as used in the phrase "dielectric block 11" is intended to refer to a three-dimensional object in general. As previously described, the superconductor-film-covered dielectric substrate 13 including the dielectric substrate 13*a* and the superconductor film 13*b* formed thereon is disposed over the dielectric block 11, and is connected to the drive mechanism 29.

FIG. 2B illustrates an example of assembling of the three-dimensional filter 5. A recess 15 is formed by use of ultrasound milling or the like in the dielectric substrate 10 made of MgO, $LaAlO_3$, or the like at the surface opposite to where the superconductor film 12 is disposed. The diameter of the recess 15 is substantially the same as the diameter of the cylindrical dielectric block 11. Fitting the dielectric block 11 into the recess 15 results in the main structure of the three-dimensional filter 5 being made as having a base platform and a projecting portion.

Alternately, as shown in FIG. 2C, a dielectric block 41 made by sintering alumina may be attached to a substrate 42 made of MgO(100). The back surface of the MgO substrate 42 is covered with a superconductor film 39. The dielectric block 41 has a flange 41*b*. The MgO substrate 42 and the flange 41*b* together constitute a base platform 40 of the three-dimensional filter. It should be noted that an $LaAlO_3$(100) substrate may be used in place of the MgO(100) substrate 42. Alternatively, a layered structure made of YBCO/$CeO_2$/$Al_2O_3$ may be processed as to the $Al_2O_3$ part thereof to be made into a superconductor-film-covered three-dimensional filter. In this case, the thickness of the $CeO_2$ film may be approximately 50 nm.

Figure 3A:
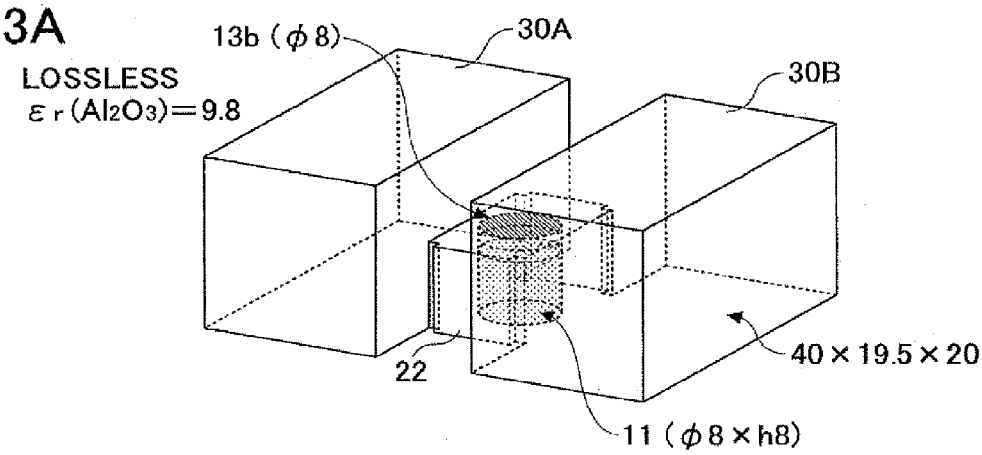
FIGS. 3A through 3C are schematic diagrams illustrating a simulation sample used to measure the frequency characteristics of the tunable filter apparatus of the first embodiment.
Figure 3B:
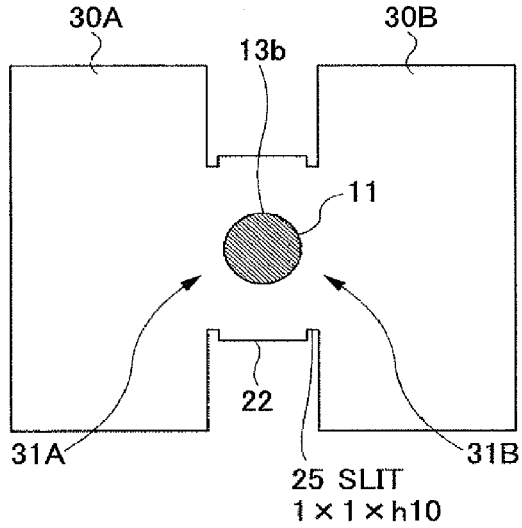
Figure 3C:
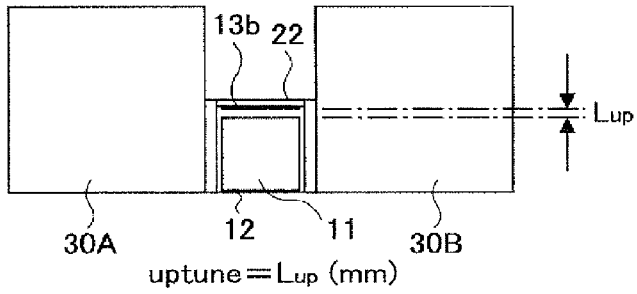

FIGS. 3A through 3B are schematic diagrams illustrating a simulation sample (model) used to measure the frequency characteristics of the tunable filter apparatus 1 having the configuration shown in FIG. 1. The cylindrical-shape dielectric block 11 having a diameter (ϕ) of 8 mm and a height (h) of 8 mm (illustrated in FIG. 3A) was placed in the conductor case 22 (illustrated in FIGS. 3A through 3C), and the superconductor film 13*b* having a diameter (ϕ) of 8 mm (illustrated in FIG. 3A) was disposed over the dielectric block 11 (illustrated in FIGS. 3A through 3C) in a movable manner. As illustrated in FIG. 3C, the superconductor film 12 was provided on the bottom surface of the dielectric block 11. The measurements of the conductor case 22 were 20 mm×11 mm×10 mm (height=10). As illustrated in FIGS. 3A through 3C, the waveguide tubes 30A and 30B were placed on respective sides of the conductor case 22. Each of the waveguide tubes was 40 mm×19.5 mm×20 mm (height=20) as illustrated in FIG. 3A.

The dielectric block 11 was made of high purity $Al_2O_3$ having a permittivity $\epsilon_r$ of 9.8 as illustrated in FIG. 3A. The superconductor film 13*b* was an epitaxial film made of high-quality c-axis-oriented YBCO. Lossless conditions (FIG. 3A) were assumed. As illustrated in FIG. 3B, the openings 31A and 31B of the conductor case 22 were made narrower by 1 mm on both sides in the width direction by use of slits 25 having a size of 1 mm×1 mm×10 mm (height h=10). In an actual device, slidable plates to be inserted into the propagation path may be used in place of the slits 25, thereby making the width of the openings 31A and 31B adjustable.

Under the conditions as described above, the elevation of the superconductor film 13*b* was adjusted to change a distance Lup (uptune) (illustrated in FIG. 3C) between the dielectric block 11 and the superconductor film 13*b*. Lup was equal to 2 mm when the superconductor film 13*b* was lifted all the way up to the ceiling of the conductor case 22. Frequency characteristics were measured while gradually moving the superconductor film 13*b* closer to the dielectric block 11 from the initial position described above.

Figure 4A:
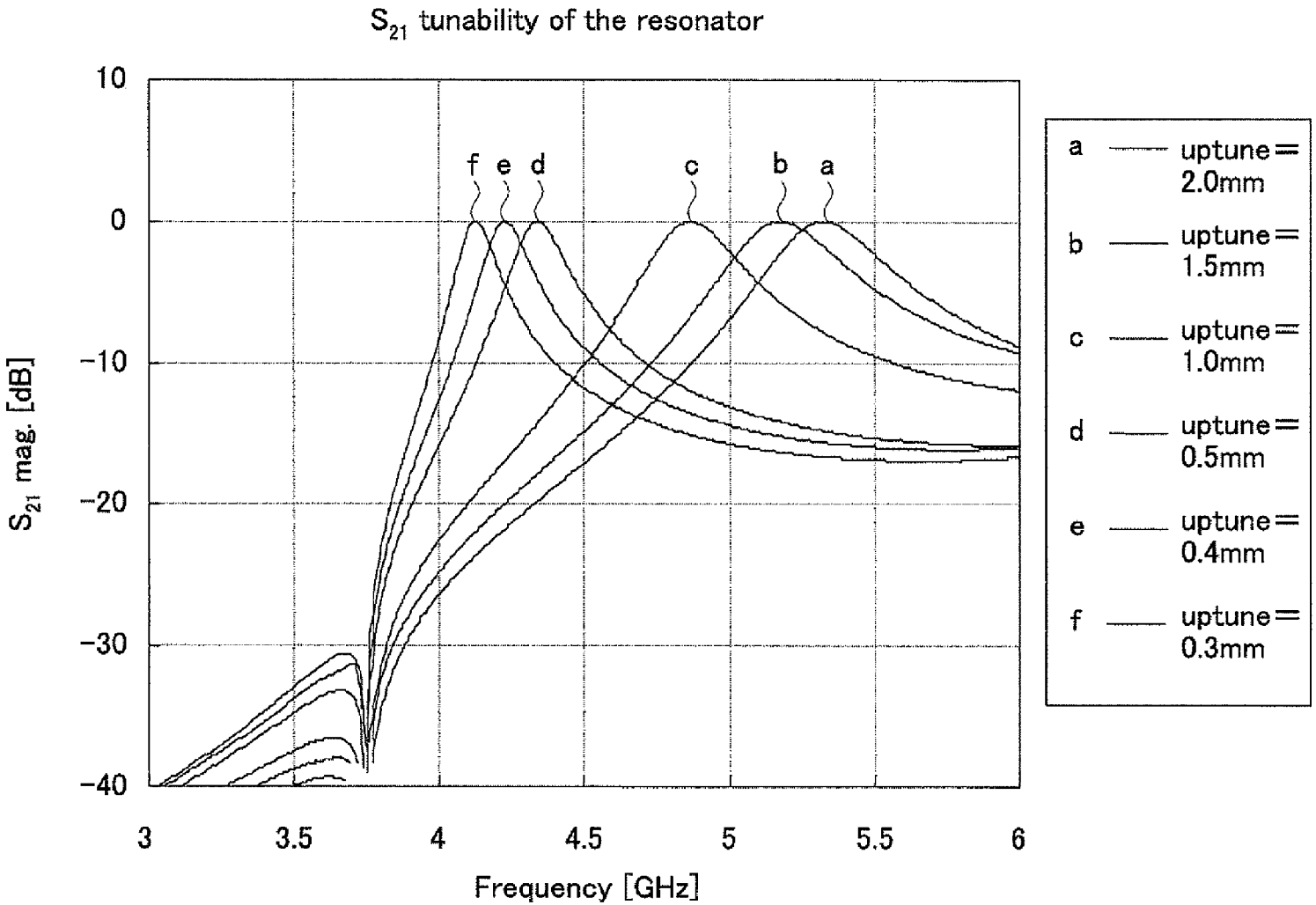
FIG. 4A is a graphic chart showing the characteristics ($S_{21}$) of the tunable filter of the first embodiment.
Figure 4B:
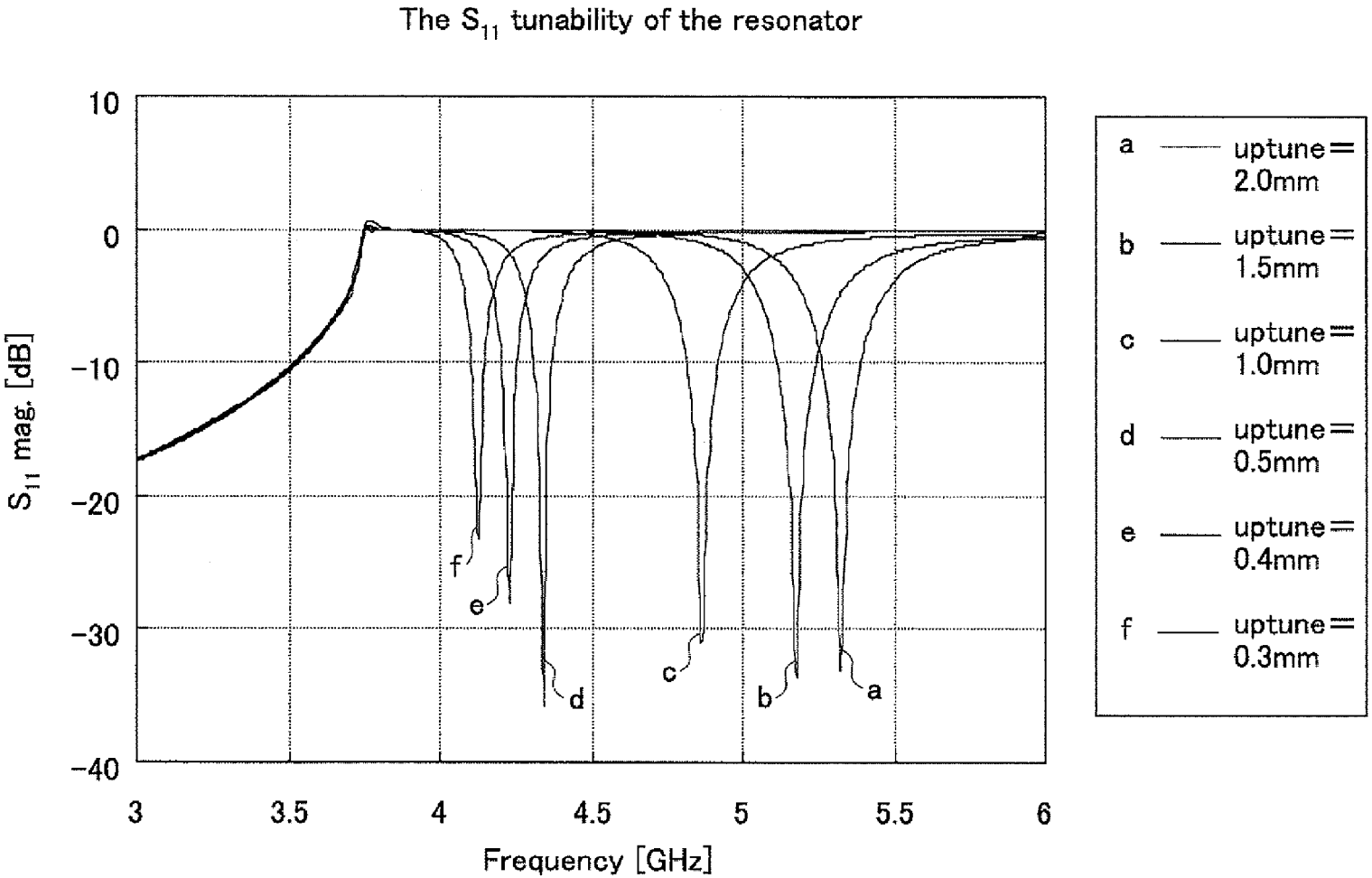
FIG. 4B is a graphic chart showing the characteristics ($S_{11}$) of the tunable filter of the first embodiment.

FIGS. 4A and 4B are graphic charts illustrating obtained measurements. FIG. 4A demonstrates $S_{21}$ (transmission) characteristics in DB vs. frequency in GHz, and FIG. 4B demonstrates $S_{11}$ (reflection) characteristics in DB vs. frequency in GHz. In FIGS. 4A and 4B and subsequent figures (i.e., FIG. 6, FIGS. 8A through 8C, FIGS. 9A through 9C), symbol "$S_{21}$" represents the transmission characteristics of the tunable filter (which is also labeled as "tunability of the resonator"), and symbol "$S_{11}$" represents the reflection characteristics of the tunable filter as measured in magnitude (as indicated by the legend "mag. [dB]"). In FIGS. 4A and 4B, the obtained characteristic profiles exhibit a significant drop around 3.75 GHz. This is because the superconductor tunable filter apparatus used as a sample was designed for high frequencies in a 5-GHz band, and the waveguide tube 30 having a cross-section of 40 mm×19.5 mm did not transmit, by its characteristics, electromagnetic waves having frequencies smaller than 3.75 GHz.

As can be seen from FIGS. 4A and 4B, the center frequency shifts toward lower frequencies as the gap Lup between the superconductor film 13*b* and the dielectric block 11 is changed from 2 mm (as designated by "a": "uptune=2.0 mm") to 1.5 mm (as designated by "b": "uptune=1.5 mm"), 1.0 mm (as designated by "c": "uptune=1.0 mm"), 0.5 mm (as designated by "d": "uptune=0.5 mm"), 0.4 (as designated by "e": "uptune=0.4 mm") mm, 0.3 mm (as designated by "f": "uptune=0.3 mm"), successively. In this manner, provision can be made such that the center frequency of the passband is variable (tunable) over a wide range. Especially in the range from around 4.2 GHz to around 4.5 GHz, a fine adjustment of the center frequency can be made while maintaining the characteristics.

A design that uses the conditions of the sample apparatus shown in FIGS. 3A through 3C and FIGS. 4A and 4B and a resonance frequency of a 5-GHz band can attain a unloaded Q factor (Qu) higher than tens of thousands. Improvements on the quality of materials and the optimization of structure size and conditions will achieve Qu higher than one million.

Figure 5:
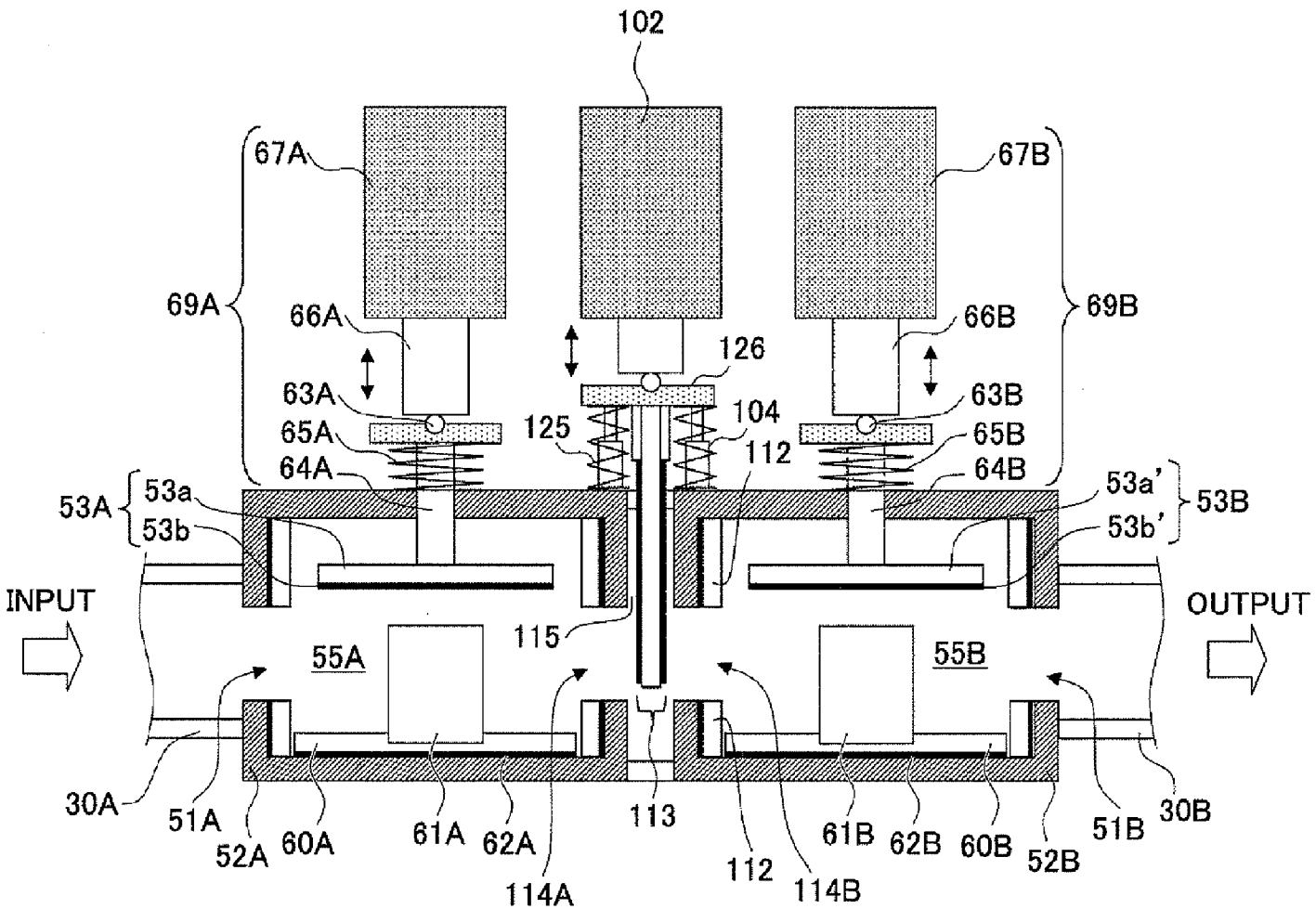
FIG. 5 is a schematic diagram of a two-stage tunable filter apparatus according to a second embodiment.

In the following, a description will be given of a tunable filter apparatus 50 according to a second embodiment with reference to FIG. 5 in which the three-dimensional resonance filters as described in the first embodiment form plural stages connected in series. The example illustrated in FIG. 5 is a two-stage bandpass filter. The tunable filter apparatus 50 includes conductor cases 52A and 52B and three-dimensional filters 55A and 55B placed inside the respective conductor cases 52A and 52B.

As in the first embodiment, each three-dimensional filter 55A (or 55B) includes a dielectric block 61A (or 61B), a superconductor film 62A (or 62B) formed on the back surface of a dielectric substrate 60A (or 60B) situated on the lower side, and a superconductor film 53*b* (or 53*b*') formed on a dielectric substrate 53*a* (or 53*a*') disposed on the upper side to be vertically movable. The dielectric substrate 53*a* (or 53*a*') and the superconductor film 53*b* (53*b*') together constitute a superconductor-film-covered dielectric substrate 53A (or 53B). The material and configuration of the dielectric block 61A (or 61B) and the material of the superconductor film are the same as those used in the first embodiment, and a description thereof will be omitted.

The adjacent faces of the conductor cases 52A and 52B have orifices (openings) 114A and 114B, respectively. A slit 115 is provided between the conductor cases 52A and 52B. A shutter 113 is inserted into the slit 115 to adjust the area size of the orifices 114A and 114B. In the illustrated example, the shutter 113 is a dielectric substrate having both surfaces thereof covered with superconductor films.

A drive mechanism for driving the shutter 113 may include an oil-less piezoelectric actuator 102 such as PZT, a movable rod 126 (which moves in a direction illustrated by a vertical double headed arrow), guides 104 for guiding the vertical movement of the movable rod 126, and springs 125. The vertical movement of the shutter 113 makes it possible to adjust the strength of electromagnetic field coupling between the three-dimensional filters (i.e., between the dielectric blocks 61A and 61B serving as resonators). Such adjustment mechanism is not limited to the shutter 113 and the disclosed drive mechanism. Any type of adjustment mechanism that can change the electromagnetic field coupling through the orifices 114A and 114B may be used. In the example illustrated in FIG. 5, the shutter 113 is configured to be vertically movable to adjust a coupling through the orifices 114A and 114B. Alternatively, the shutter may be configured to be horizontally movable to change the effective area size of the orifices 114A and 114B.

In the same manner as in the first embodiment, the superconductor-film-covered dielectric substrates 53A and 53B held inside the respective conductor cases 52A and 52B are connected to respective drive mechanisms 69A and 69B to be adjustable as to their positions relative to the dielectric blocks 61A and 61B, respectively. This arrangement makes it possible to adjust and align the resonance frequencies of the three-dimensional filters. The configuration of the drive mechanisms 69A and 69B is the same as that used in the first embodiment. The drive mechanisms 69A and 69B mainly include movable rods 64A and 64B, springs 65A and 65B, ball joints 63A and 63B, piezoelectric actuators 67A and 67B, and actuator movable parts (displaceable parts) 66A and 66B (which move in a direction illustrated by vertical double headed arrows), respectively. A detailed description of these elements will be omitted.

Openings 51A and 51B are provided on the opposite side of the conductor cases 52A and 52B to the side where the orifices 114A and 114B are provided, respectively. The openings 51A and 52B are connected to the waveguide tubes 30A and 30B, respectively. In the same manner as in the first embodiment, the interior side walls of the conductor cases 52A and 52B are covered with superconductor-film-covered dielectric substrates 112.

The flow of signals through the multi-stage filter of the second embodiment is as follows. A signal propagating through the waveguide tube 30A as illustrated in FIG. 5 by a horizontal arrow indicated as "INPUT" is incident on the dielectric block 61A serving as a first three-dimensional resonator. A signal corresponding to the natural resonance frequency of the dielectric block 61A passes through the dielectric block 61A. Part of the above-noted passing signal passes through the orifices 114A and 114B having the area size thereof adjusted by the shutter 113, and the remaining part is reflected. The signal propagating through the orifices 114A and 114B is incident on the dielectric block 61B serving as a second three-dimensional resonator. A signal corresponding to the natural resonance frequency of the dielectric block 61B passes through the opening 51B to enter the waveguide tube 30B as illustrated in FIG. 5 by a horizontal arrow indicated as "OUTPUT".

As previously described, the resonance frequencies of the first and second three-dimensional resonators (dielectric blocks) 61A and 61B are adjusted to be equal to each other by controlling the positions of the superconductor films 53*b* and 53*b*'. Further, resonating electromagnetic field coupling between the dielectric blocks 61A and 61B is adjusted by controlling the area size of the orifices 114A and 114B through the adjustment of the position of the shutter 113, thereby adjusting the bandwidth. In this manner, the two-stage bandbass filter according to the second embodiment is provided with a tunable center frequency and a tunable bandwidth.

The entirety of such two-stage bandpass filter is placed in a vacuum cooling chamber (not shown). Each of the dielectric blocks 61A and 61B functions as an electromagnetic-field resonator having a high unloaded Q factor at temperature sufficiently lower than a superconductivity critical temperature Tc. When the dielectric blocks 61A and 61B are formed as a cylinder, the electrical field of the incoming electromagnetic waves will be concentrated, thereby preventing the pinpoint concentration of electrical fields on the superconductor films.

Figure 6:
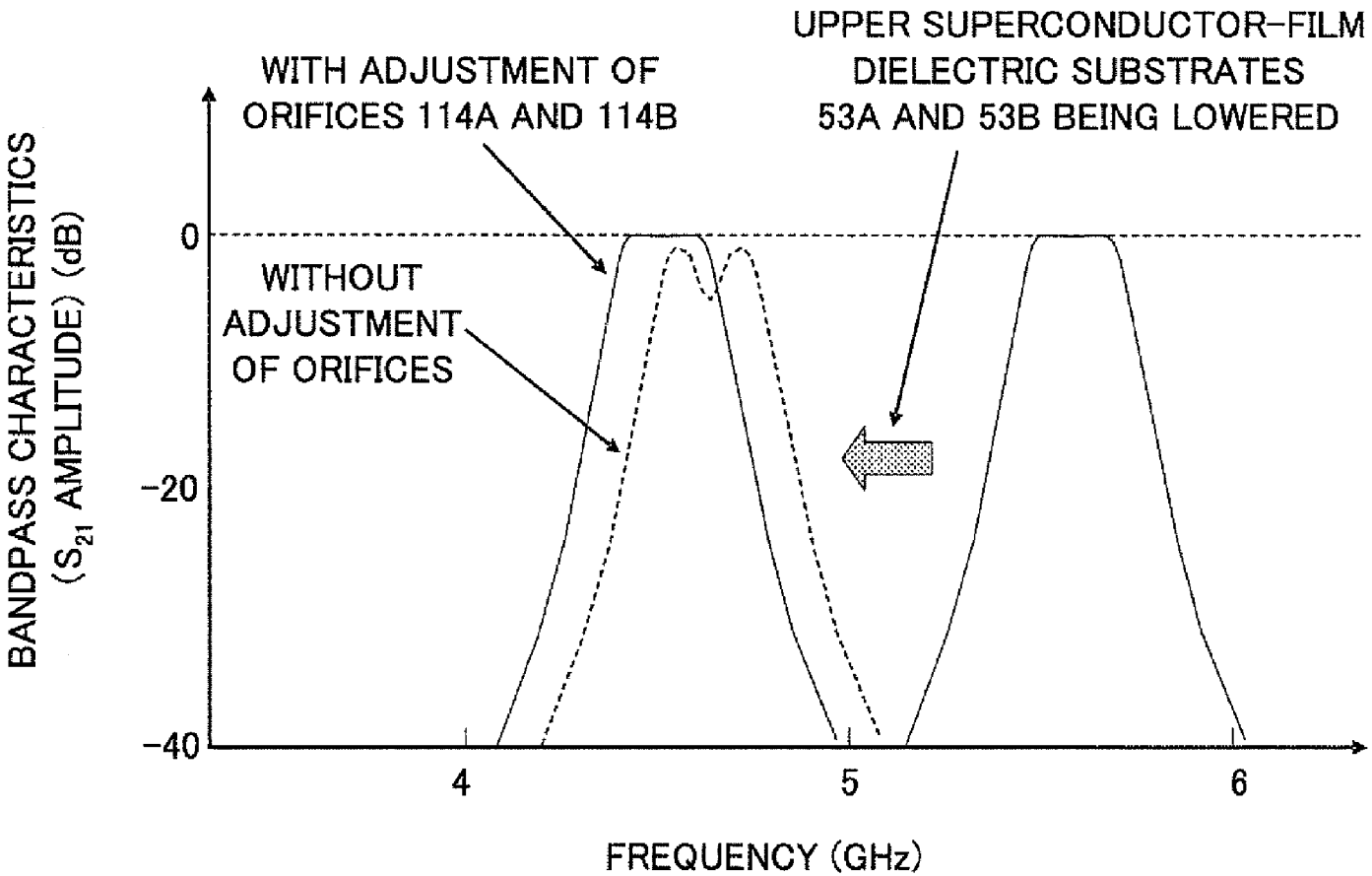
FIG. 6 is an illustrative drawing demonstrating the effect of tuning of the two-stage tunable filter apparatus of FIG. 5.

FIG. 6 is an illustrative drawing demonstrating the effect of tuning of the tunable filter apparatus 50 according to the second embodiment. In FIG. 6, the horizontal axis represents frequency, and the vertical axis represents bandpass characteristics, i.e., the $S_{21}$ amplitude. Without adjusting a coupling through the orifices 114A and 114B, the elevations of the superconductor-film-covered dielectric substrates 53A and 53B may be lowered by the same shift amount from their upper limit positions over the first and second three-dimensional resonators (dielectric blocks) 61A and 61B, respectively, as illustrated in FIG. 6 by a horizontal arrow indicated as "UPPER SUPERCONDUCTOR-FILM DIELECTRIC SUBSTRATES 53A AND 53B BEING LOWERED". In such a case, the peak is divided to produce a double-peaked curve as illustrated by the dotted curved line indicated as "WITHOUT ADJUSTMENT OF ORIFICES". The coupling area size of the orifices 114A and 114B may then be widened (by raising the shutter 113 in the case of the second embodiment) to strengthen a coupling between the dielectric blocks 61A and 61B. This results in the double-peaked dotted-line curve being changed into a single-peaked curve as shown by a solid curved line indicated as "WITH ADJUSTMENT OF ORIFICES 114A AND 114B".

Figure 7A:
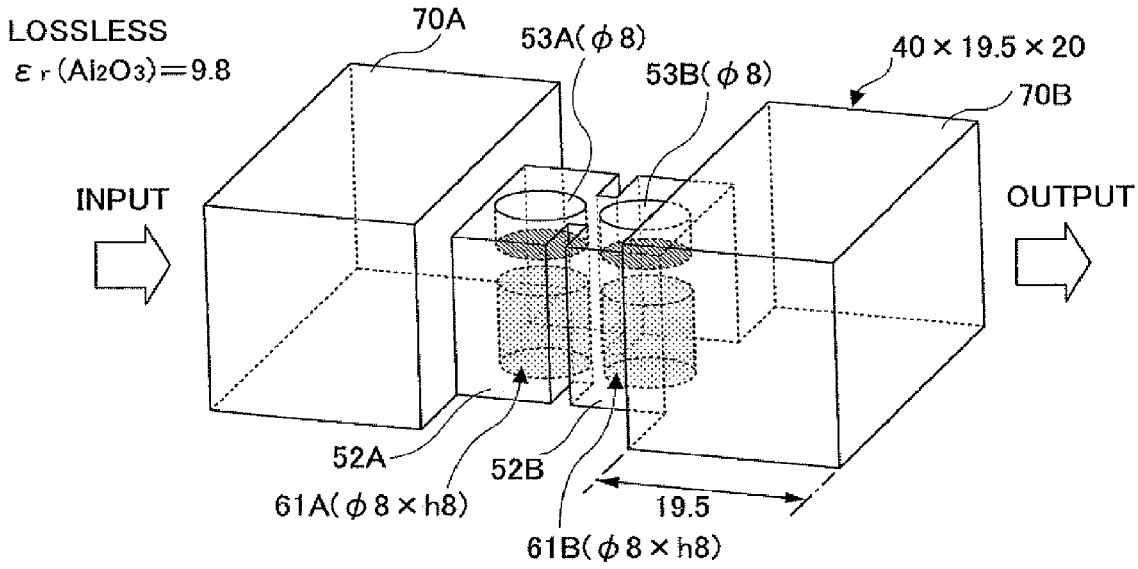
FIG. 7A is a drawing illustrating a simulation model sample of the two-stage tunable filter apparatus of the second embodiment.
Figure 7B:
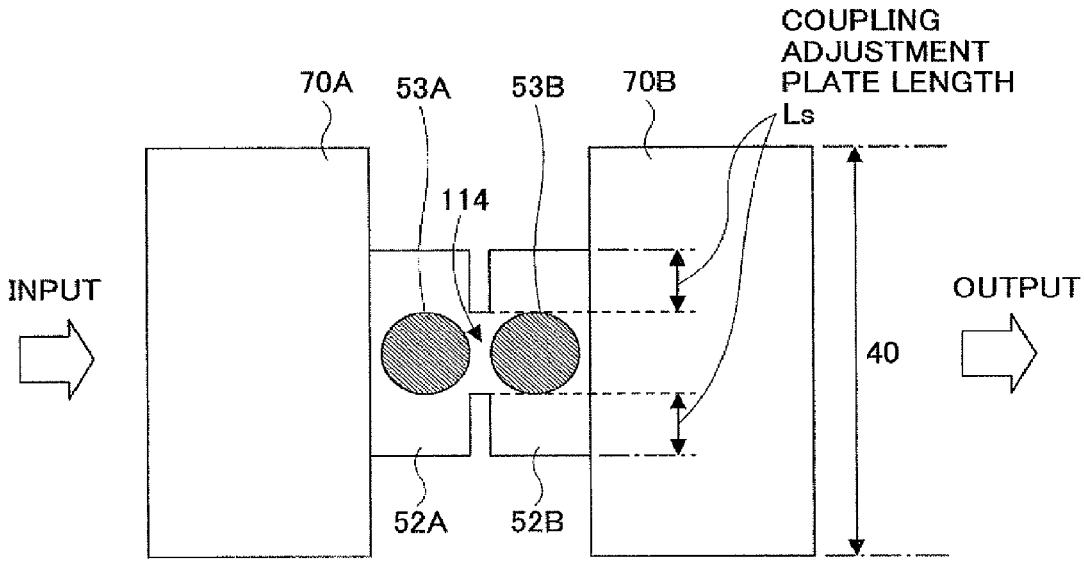
FIG. 7B is a drawing illustrating the simulation model sample of the two-stage tunable filter apparatus of the second embodiment.
Figure 7C:
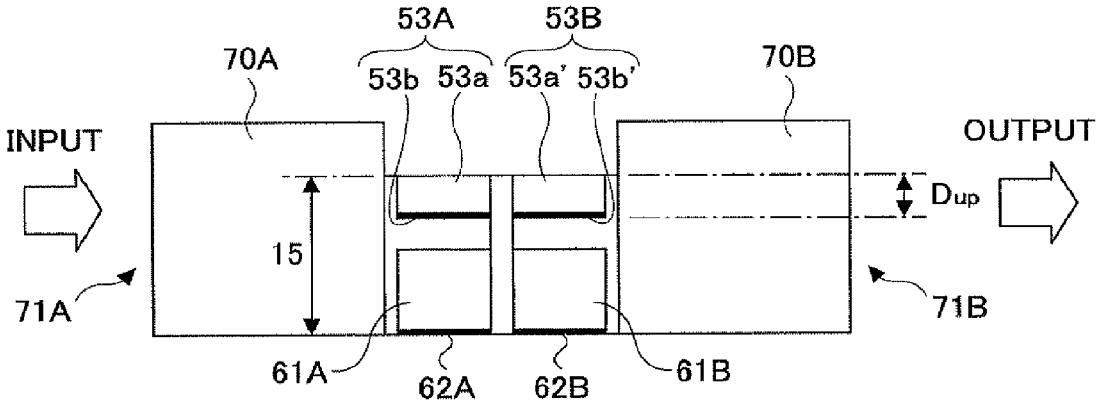
FIG. 7C is a drawing illustrating the simulation model sample of the two-stage tunable filter apparatus of the second embodiment.

FIGS. 7A through 7C are drawings illustrating a simulation sample (model) of the two-stage three-dimensional filter of the second embodiment. Waveguide tubes 70A and 70B each having a size of 40 mm×19.5 mm×20 mm (the dimensions illustrated in FIG. 7A and partly in FIG. 7B) were connected to the input side of the conductor case 52A and the output side of the conductor case 52B (illustrated in FIGS. 7A through 7C), respectively. A signal propagating as illustrated by a horizontal arrow indicated as "INPUT" enters the waveguide tube 70A, and a signal propagating as illustrated by a horizontal arrow indicated as "OUTPUT" exits from the waveguide tube 70B. As illustrated in FIG. 7C, an opening 71A of the waveguide tube 70A served as an input port, and an opening 71B of the waveguide tube 70B served as an output port.

The dielectric blocks 61A and 61B were made of high purity $Al_2O_3$ having a permittivity $\in_r$ of 9.8 as illustrated in FIG. 7A. Lossless conditions (FIG. 7A) were assumed. The cylindrical dielectric blocks 61A and 61B each having a diameter (φ) of 8 mm and a height (h) of 8 mm (illustrated in FIG. 7A) were placed in the conductor cases 52A and 52B, respectively. The height of the conductor cases 52A and 52B was 15 mm as illustrated in FIG. 7C. As illustrated in FIGS. 7A and 7C, the superconductor-film-covered dielectric substrates 53A and 53B were situated over the dielectric blocks 61A and 61B, respectively. The superconductor films 62A and 62B were provided on the bottom surfaces of the dielectric blocks 61A and 61B (illustrated in FIG. 7C), respectively.

As illustrated in FIG. 7C, the thickness of the superconductor-film-covered dielectric substrate 53A (53B), i.e., the distance between the upper surface of the dielectric substrate 53*a* (53*a*') and the lower surface of the superconductor film 53*b* (53*b*') (i.e., the surface that faces the dielectric block 61A (61B)), was denoted as Dup. Dup was changed to adjust the distance between the superconductor film 53*b* (53*b*') and the dielectric block 61A (61B).

Coupling adjustment plates (corresponding to the shutter 113 illustrated in FIG. 5) were inserted into the space between the two conductor cases 52A and 52B from both sides from the horizontal direction to adjust the width (i.e., area size) of the orifice 114 as illustrated in FIG. 7B. The length of the part of each coupling adjustment plate that was inserted into the space was denoted as a coupling adjustment plate length Ls.

Figure 8A:
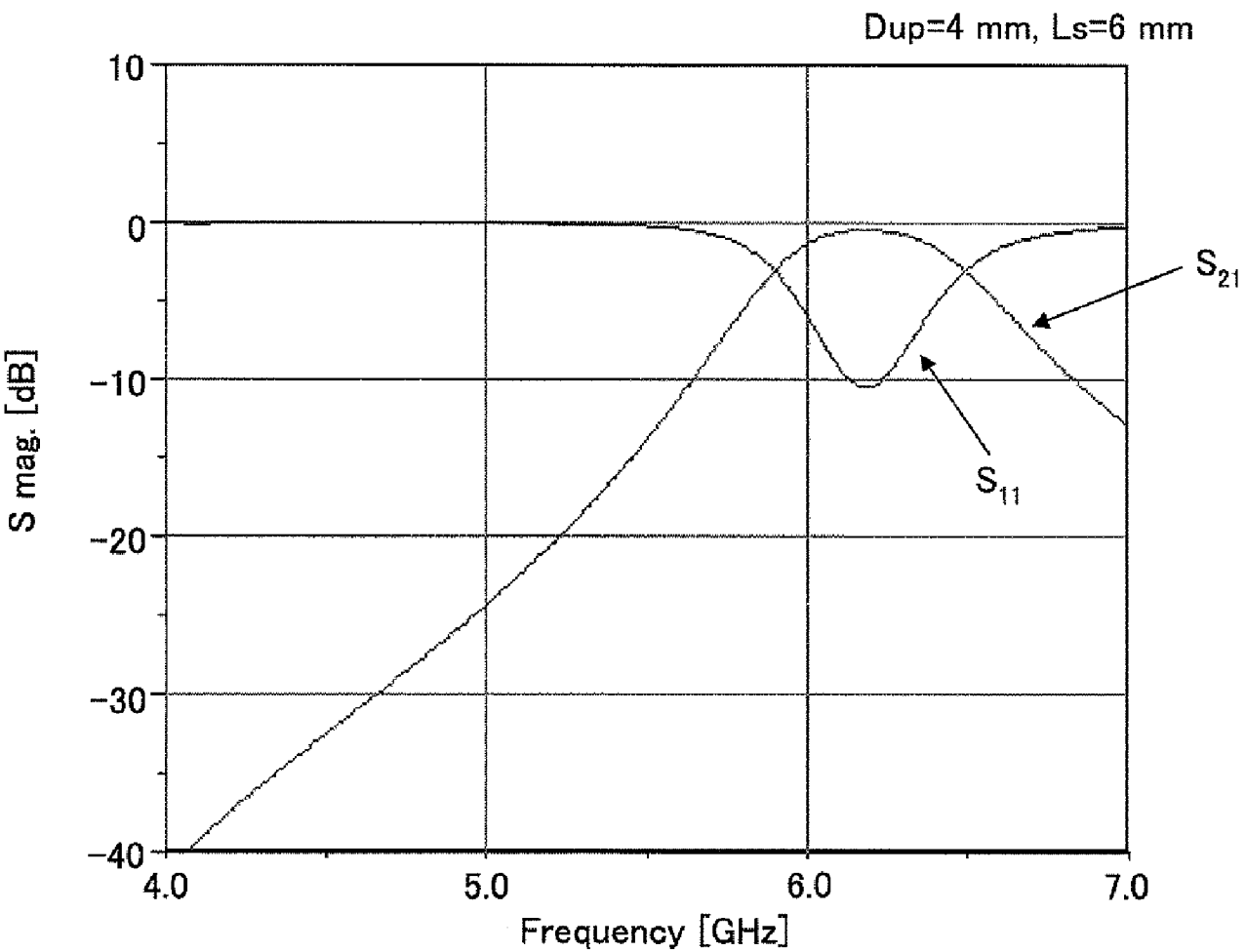
FIG. 8A is a graphic chart illustrating characteristics observed when the thickness Dup of a superconductor-film-covered dielectric substrate is changed while keeping a coupling adjustment plate length Ls constant.
Figure 8B:
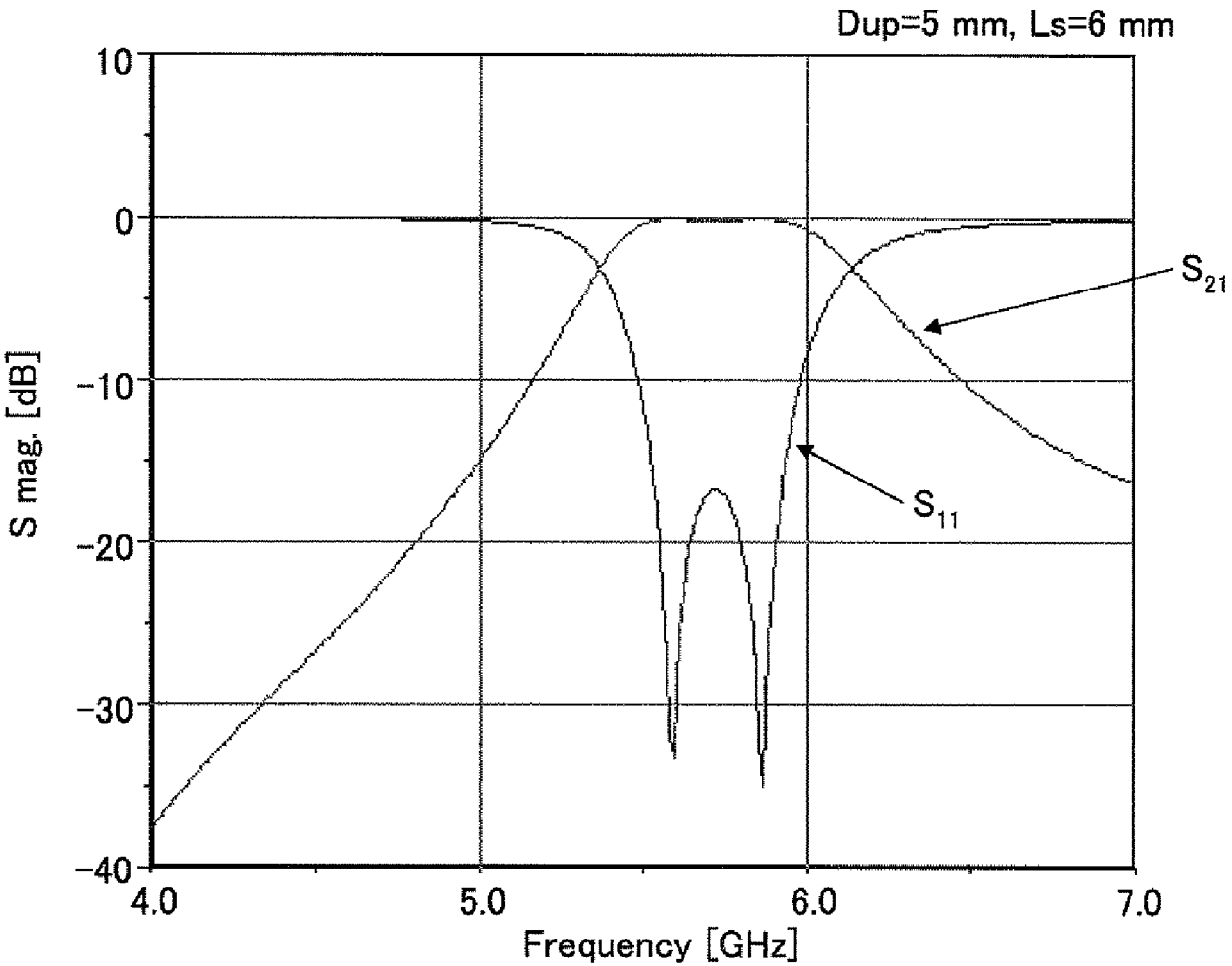
FIG. 8B is a graphic chart illustrating characteristics observed when the thickness Dup of the superconductor-film-covered dielectric substrate is changed while keeping the coupling adjustment plate length Ls constant.
Figure 8C:
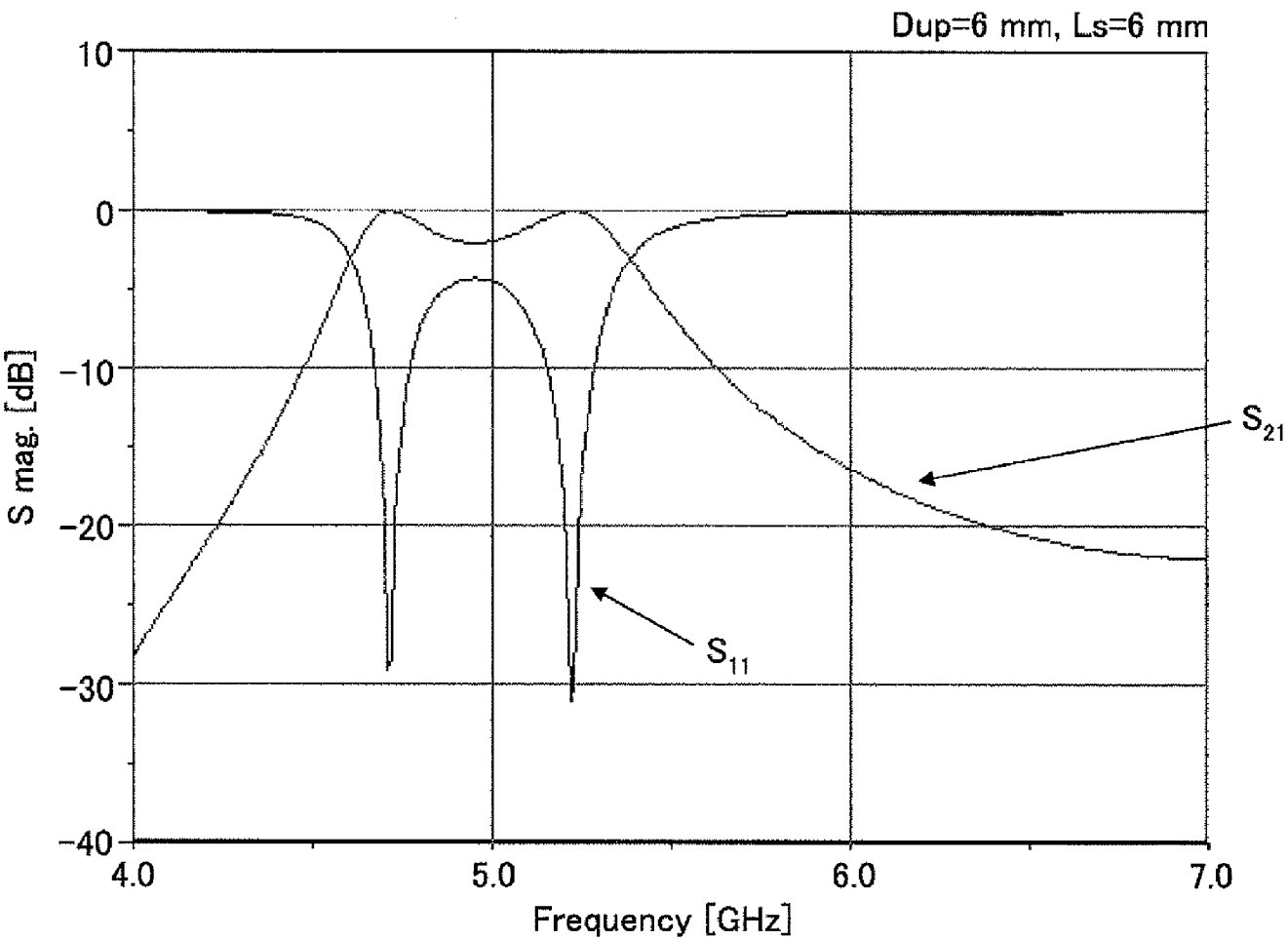
FIG. 8C is a graphic chart illustrating characteristics observed when the thickness Dup of the superconductor-film-covered dielectric substrate is changed while keeping the coupling adjustment plate length Ls constant.

FIGS. 8A through 8C are graphic charts illustrating changes in frequency characteristics observed when the thickness Dup of the superconductor-film-covered dielectric substrates 53A and 53B were changed from 4 mm (FIG. 8A) to 5 mm (FIG. 8B) and then to 6 mm (FIG. 8C) to bring the superconductor films 53*b* and 53*b*' closer to the dielectric blocks 61A and 61B, respectively, while maintaining the coupling adjustment plate length Ls at 6 mm in the simulation model illustrated in FIGS. 7A through 7C. In FIGS. 8A through 8C, $S_{21}$ (transmission) characteristics in DB vs. frequency in GHz and $S_{11}$ reflection characteristics in DB vs. frequency in GHz are illustrated. As the distance between the superconductor films 53*b* and 53*b*' and the dielectric blocks 61A and 61B decreases, filter frequency characteristics appear increasingly prominently, and the center frequency shifts toward lower frequencies, with decreased reflection at the desired band (e.g., a 5-GHz band in this example).

Figure 9A:
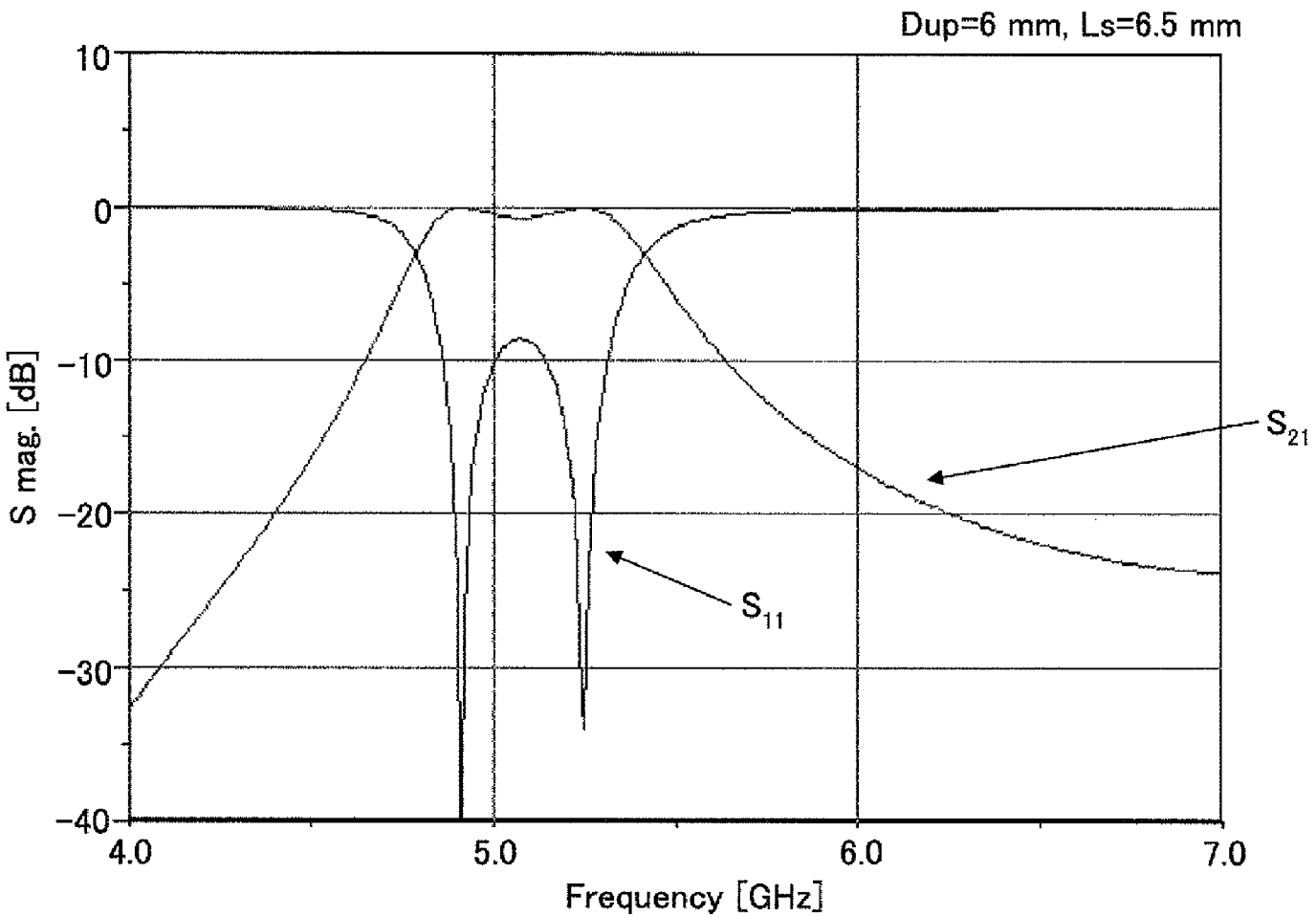
FIG. 9A is a graphic chart illustrating characteristics observed when the thickness Dup of a superconductor-film-covered dielectric substrate is kept constant while changing a coupling adjustment plate length Ls.
Figure 9B:
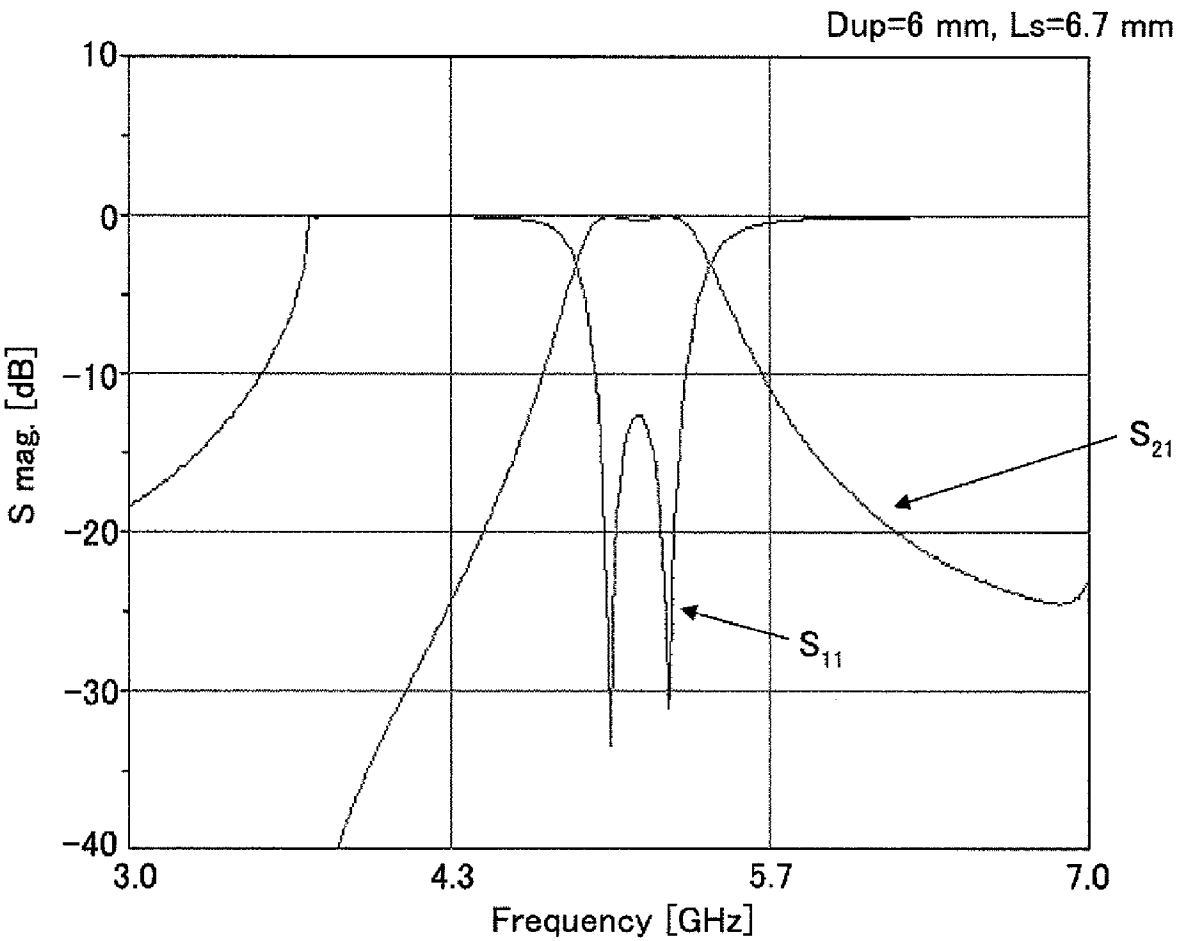
FIG. 9B is a graphic chart illustrating characteristics observed when the thickness Dup of the superconductor-film-covered dielectric substrate is kept constant while changing the coupling adjustment plate length Ls.
Figure 9C:
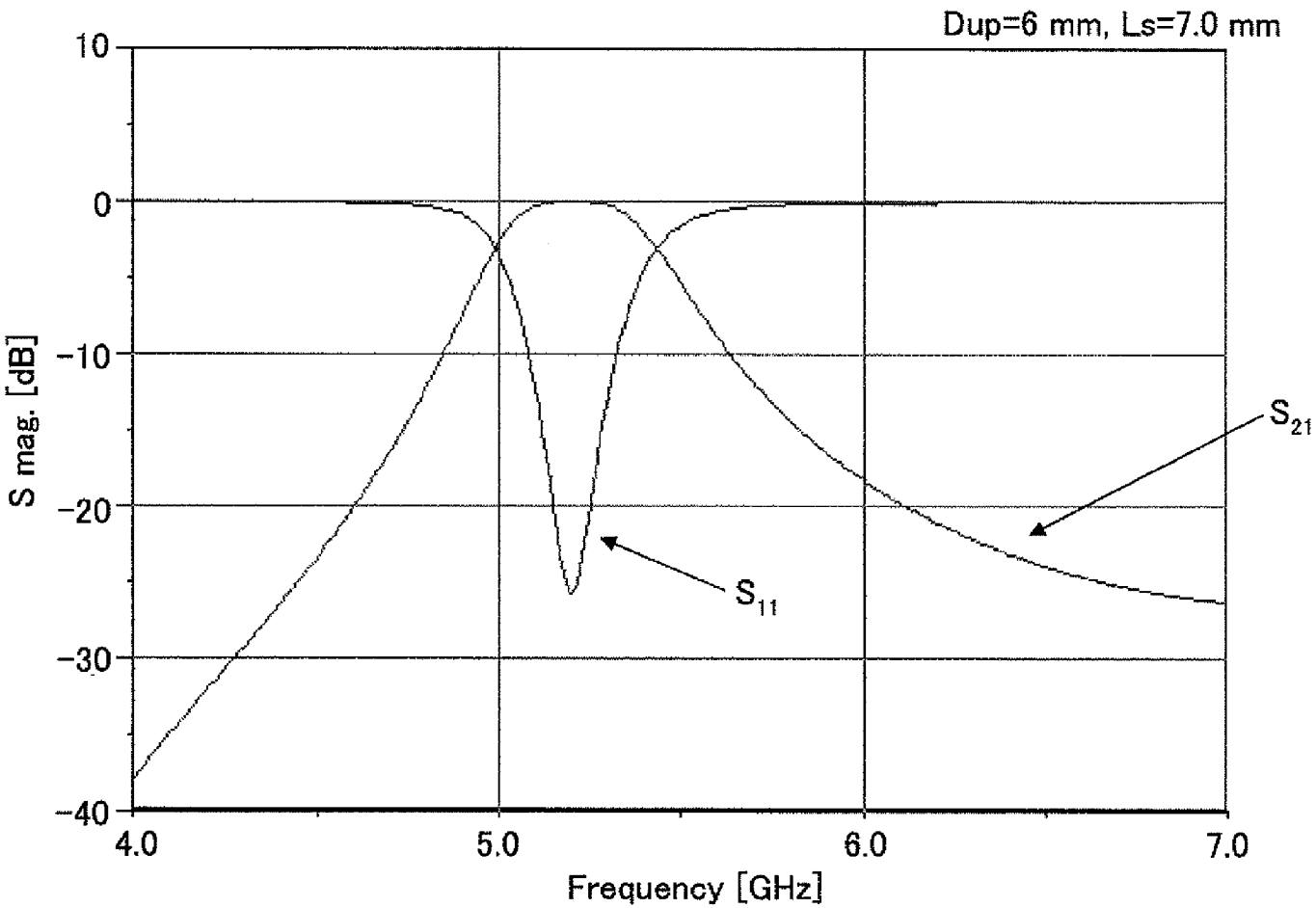
FIG. 9C is a graphic chart illustrating characteristics observed when the thickness Dup of the superconductor-film-covered dielectric substrate is kept constant while changing the coupling adjustment plate length Ls.

FIGS. 9A through 9C are graphic charts illustrating changes in frequency characteristics observed when the coupling adjustment plate length Ls was changed from 6.5 mm (FIG. 9A) to 6.7 mm (FIG. 9B) and then to 7.0 mm (FIG. 9C) by narrowing the width of the orifice 114 while maintaining the thickness Dup of the superconductor-film-covered dielectric substrates 53A and 53B fixed at 6 mm in the simulation model illustrated in FIGS. 7A through 7C. In FIGS. 9A through 9C, $S_{21}$ (transmission) characteristics in DB vs. frequency in GHz and $S_{11}$ (reflection) characteristics in DB vs. frequency in GHz are illustrated. As the width of the orifice 114 is decreased by changing the coupling adjustment plate length Ls from 6.5 mm to 6.7 mm, the signal bandwidth is decreased. An excessive narrowing, however, results in the weakening of filter characteristics as shown in FIG. 9C.

In FIG. 9B, the lower frequency portion of the $S_{21}$ characteristics exhibits a drop. This is because the simulation sample was designed for high frequencies in a 5-GHz band, and the waveguide tubes 70A and 70B each having a cross-section of 40 mm×19.5 mm did not transmit, by their characteristics, electromagnetic waves having frequencies smaller than 3.75 GHz.

In this manner, the two-stage three-dimensional filter configuration can adjust at least one of the center frequency and the bandwidth during the ongoing operation of the tunable filter apparatus 50. Such adjustment can be made by adjusting at least one of the position of the superconductor films 53*b* and 53*b*' relative to the respective dielectric blocks 61A and 61B and the width of the orifice situated between the three-dimensional filters. Although the embodiments have been described heretofore by referring to particular examples of configurations, the present invention is not limited to these examples. For example, the dielectric blocks 11, 61A, and 61B are not limited to a cylindrical shape, but may be a rectangular solid. The superconductor film is not limited to YBCO, but may be a metal superconductor such as Nb, Nb—Ti, $Nb_3Sn$, Pb, or Pb alloy, or may be an oxide high-temperature superconductor such as RBCO (R: Nd, Sm, Ho, Gd) or BSCCO. The dielectric block used as a resonator may be made of crystal including an oxide of one or more materials selected from Mg, Al, Ti, and Sr, or may be made of ceramic material.

The embodiments described heretofore provide the following advantages:

the use of a three-dimensional filter including a superconductor film having small conduction loss and a dielectric block resonator having small dielectric loss can provide a high unloaded Q factor (Qu);

the use of a configuration in which resonating electrical fields concentrate on the dielectric block can suppress the pinpoint concentration of electromagnetic fields on the superconductor film, thereby providing better power tolerance when compared with a planar-circuit-type superconductor resonator; and tunable bandpass characteristics are obtained to allow the adjustment of the center frequency and width of the passband.

Such a three-dimensional filter and tunable filter apparatus 1 are suitable for the sharing of radio waves that has been gradually put into practical use in radio communication systems, i.e., suitable for efficient utilization of radio resources that actively utilizes available frequencies.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A three-dimensional filter, comprising:

two superconductor films opposed to each other; and a three-dimensional resonator made of dielectric and situated between the two superconductor films, wherein one of the two superconductor films is movable relative to the three-dimensional resonator to maintain a controllable distance between the three-dimensional resonator and the movable one of the two superconductor films, and the movable one of the two superconductor films directly faces a dielectric surface of the three-dimensional resonator, and wherein the three-dimensional resonator is not in direct contact with another one of the two superconductor films.

2. The three-dimensional filter as claimed in claim 1, wherein the two superconductor films are arranged on two opposite sides of the three-dimensional resonator, respectively, across a signal propagation path.

3. The three-dimensional filter as claimed in claim 1, further comprising:

a first dielectric substrate situated over the three-dimensional resonator; and a second dielectric substrate situated under the three-dimensional resonator, wherein said movable one of the two superconductor films is disposed on a surface of the first dielectric substrate that faces the three-dimensional resonator, and the another one of the two superconductor films is disposed on a surface of the second dielectric substrate on an opposite side to the three-dimensional resonator.

4. The three-dimensional filter as claimed in claim 3, wherein the second dielectric substrate has a recess, into which the three-dimensional resonator is engaged.

5. The three-dimensional filter as claimed in claim 3, further comprising a drive mechanism coupled to the first dielectric substrate.

6. The three-dimensional filter as claimed in claim 1, wherein the three-dimensional resonator is a dielectric block having a cylindrical shape or rectangular solid shape.

7. The three-dimensional filter as claimed in claim 1, wherein said movable one of the two superconductor films is not electrically connected to any other electrical conductor in the three-dimensional filter.

8. The three-dimensional filter as claimed in claim 1, further comprising:

a case in which the two superconductor films and the three-dimensional resonator are placed, the case having a hole;

a drive mechanism situated outside the case; and a rod slidable through the hole of the case, wherein the drive mechanism configured to slide the rod through the hole of the case to change a position of said movable one of the two superconductor films relative to the three-dimensional resonator by the sliding movement of the rod.

9. A tunable filter apparatus, comprising:

a conductor case;

a three-dimensional filter including two superconductor films opposed to each other and a three-dimensional resonator situated between the two superconductor films, wherein one of the two superconductor films is configured to be movable relative to the three-dimensional resonator to maintain a controllable distance between the three-dimensional resonator and the movable one of the two superconductor films, and the movable one of the two superconductor films directly faces a dielectric surface of the three-dimensional resonator; and first and second waveguides coupled to the conductor case along a direction perpendicular to a direction in which said one of the two superconductor films is movable, wherein the three-dimensional resonator is not in direct contact with another one of the two superconductor films.

10. The tunable filter apparatus as claimed in claim 9, further comprising a drive mechanism configured to change a position of said movable one of the two superconductor films relative to the three-dimensional resonator.

11. A tunable filter apparatus, comprising:

first and second conductor cases arranged adjacent to each other;

an opening disposed on adjacent faces of the first and second conductor cases;

first and second three-dimensional filters placed in the first and second conductor cases, respectively; and a shutter that is inserted into a space between the first and second conductor cases and that is movable to adjust an area size of the opening, wherein each of the first and second three-dimensional filters includes two superconductor films and a three-dimensional resonator situated between the two superconductor films, so that the respective three-dimensional resonators are each associated with the two corresponding superconductor films, wherein a respective one of the two superconductor films is configured to be movable relative to the corresponding three-dimensional resonator to maintain a controllable distance between the respective three-dimensional resonator and the movable one of the corresponding two superconductor films, and the respective movable one of the two superconductor films directly faces a dielectric surface of the corresponding three-dimensional resonator, and wherein the respective three-dimensional resonator is not in direct contact with another one of the corresponding two superconductor films.

12. The tunable filter apparatus as claimed in claim 11, further comprising:

a first waveguide tube coupled to the first conductor case on an opposite side to the opening; and a second waveguide tube coupled to the second conductor case on an opposite side to the opening, wherein a movable direction of said one of the two superconductor films in each of the first and second three-dimensional filters is perpendicular to a direction in which the first and second waveguide tubes extend.

* * * * *